US007267921B2

(12) United States Patent
Chung et al.

(10) Patent No.: US 7,267,921 B2
(45) Date of Patent: Sep. 11, 2007

(54) PROCESS FOR FORMING TONERS FROM DRY PIGMENTS

(75) Inventors: Joo T. Chung, Webster, NY (US); Scott M. Silence, Fairport, NY (US); Joseph L. Leonardo, Penfield, NY (US)

(73) Assignee: Xerox Corporation, Stamford, CT (US)

( * ) Notice: Subject to any disclaimer, the term of this patent is extended or adjusted under 35 U.S.C. 154(b) by 356 days.

(21) Appl. No.: 11/003,662

(22) Filed: Dec. 3, 2004

(65) Prior Publication Data

US 2006/0121378 A1 Jun. 8, 2006

(51) Int. Cl.
*G03G 9/08* (2006.01)

(52) U.S. Cl. ..... 430/137.1; 430/105

(58) Field of Classification Search ..... 430/137.1, 430/105

See application file for complete search history.

(56) References Cited

U.S. PATENT DOCUMENTS

| | | | | |
|---|---|---|---|---|
| 5,536,613 | A * | 7/1996 | Chang et al. | 430/137.1 |
| 5,885,739 | A * | 3/1999 | Dalal et al. | 430/107.1 |
| 6,593,049 | B1 | 7/2003 | Veregin et al. | |
| 6,756,176 | B2 | 6/2004 | Stegamat et al. | |
| 2004/0142266 | A1 | 7/2004 | Sacripante et al. | |

* cited by examiner

*Primary Examiner*—John L Goodrow
(74) *Attorney, Agent, or Firm*—Eugene O. Palazzo; Fay Sharpe LLP

(57) ABSTRACT

A process for preparing toner compositions using a dry pigment is provided. The process comprises combining a base toner resin composition, a dry pigment, and dispersion agent in a one step process, without the need any pre-processing of the pigments such as by, for example, flushing. The process includes combining the base toner resin, dry pigment and dispersion agent in a processing apparatus such as an extruder. The process may also comprise preparing the toners via an extrusion process utilizing a screw having a configuration designated herein as a Type C screw.

15 Claims, 6 Drawing Sheets

PROCESS FOR FORMING TONERS FROM DRY PIGMENTS

BACKGROUND

Illustrated herein, in various exemplary embodiments, is a process for forming toner compositions for use in electrophotographic and xerographic printing processes, and the toners formed thereby. In particular, the disclosure relates to a process for forming a toner particle by combining a base toner composition, dry pigment and a dispersing agent in a single processing step. The process is particularly directed to forming toner particles for xerographic printing processes and will be described with particular reference thereto. It will be appreciated that the process may be amenable to forming other pigmented items.

In an electrophotographic application such as xerography, a charge retentive surface (i.e., photoconductor, photoreceptor, or imaging surface) is electrostatically charged and exposed to a light pattern of an original image to be reproduced to selectively discharge the surface in accordance therewith. The resulting pattern of charged and discharged areas on that surface form an electrostatic charge pattern (an electrostatic latent image) conforming to the original image. The latent image is developed by contacting it with a finely divided electrostatically attractable powder referred to as "toner." Toner is held on the image areas by the electrostatic charge on the surface. Thus, a toner image is produced in conformity with a light image of the original being reproduced. The toner image may then be transferred to a substrate (e.g., paper), and the image affixed thereto to form a permanent record of the image to be reproduced. Subsequent to development, excess toner left on the charge retentive surface is cleaned from the surface.

The aforementioned process is known, and useful for light lens copying from an original, and printing applications from electronically generated or stored originals, where a charged surface may be image-wise discharged in a variety of ways. Ion projection devices where a charge is image-wise deposited on a charge retentive substrate operate similarly.

Electrophotographic imaging members are commonly multilayered photoreceptors that, in a negative charging system, include a substrate support, an optional electrically conductive layer, an optional charge blocking layer, an optional adhesive layer, a charge generating layer, a charge transport layer, and an optional overcoating layer. The photoreceptor or imaging members can take several forms, including flexible belts, rigid drums, and the like.

Toners employed in color electrostatographic or xerographic printing processes include pigments to impart color to the toner particles and compositions. Color toners are generally prepared using pigment concentrates and dispersions. Dry pigment materials may be directly used to form color toner particles or compositions.

Pigment dispersions are often utilized in the form of flushed color dispersions, which are also known and referred to as pigment flushes or flushed pigments. Flushed pigments are prepared by a process known as "flushing." Flushing involves removing water from a pigment presscake with a vehicle that is compatible with the final toner binder resin. In the flushing process, pigment presscake is loaded into the flusher and a resin or oil is added to yield a high viscosity paste. The paste is then mixed until a dispersion is formed. The resin displaces the water surrounding the pigment particles, which separates into a clear layer that is poured or decanted off. It may take several cycles of the above steps to fully remove the water and replace it with the resin. The final traces of water may be removed by heat and/or vacuum. Following their preparation, the flushed pigments are added to the melt blending step of the toner preparation process.

Flush pigments offer several advantages over dry pigments. Mixing dry pigments with other toner ingredients often results in non-uniform dispersions, which may result in toners with poor color quality. Uniform dispersion of a colorant, such as a pigment, is important to obtain a large color gamut, minimize the amount of toner laid down on a page, and to achieve reproducible color, electrostatic, and other physical properties. Additionally, uniform dispersion is important in optimizing the production costs for obtaining the toner. Further, dry pigments are often too difficult to handle and meter.

One of the drawbacks to the use of flush pigments is an increase in the cost to produce toners using such pigments. Namely, the processing steps to obtain flushed pigments add to the costs of producing such pigments and, therefore, add to the cost of producing toners with flush pigments. Consequently, there is a need to provide a process for forming a toner composition that can utilize dry pigments, and eliminate the flushing step or process. It is also desirable to provide a process, utilizing dry pigments free from any flushing process, which provides a toner composition that exhibits satisfactory dispersion and provides colors and other properties comparable to toners prepared from flush pigments.

Additionally, it is desirable to provide a xerographic printing process that provides a high print quality such that it may be a suitable alternative to offset lithography. Generally, offset lithography demands a level of print quality much higher than is available with typical xerographic machines and processes. Additionally, offset lithography is more cost effective for long print runs. Xerography and the digital imaging processes of certain xerographic products allows customization of each print, such as an address, or special information for regional distribution, which is not practical with offset lithography. It is therefore desirable to provide a xerographic printing process that can produce prints of sufficient quality such that it may be a suitable, low cost, alternative to offset lithography, and particularly when the desired number of prints is below a certain number corresponding to the break even point for lengthy pre-press activities.

Therefore, it is desirable to provide toners formed from dry pigments that exhibit satisfactory dispersion and provide colors and other properties comparable to toners prepared from flush pigments. Along these lines, it is desirable to provide a process for preparing toners using dry pigments.

BRIEF DESCRIPTION

Illustrated herein, in one aspect, is a process for forming a toner composition. The process comprises providing an extrusion apparatus, combining a base toner resin composition, a dry pigment, and a dispersion agent in the extrusion apparatus; and forming a color toner by subjecting said base toner resin composition, said dry pigment, and said dispersion agent to an extrusion process.

In another aspect, disclosed herein is a process for preparing a toner comprising providing a base toner resin composition; adding the base toner resin composition, a dry pigment, and a dispersion agent to an extruder; and subjecting the base toner, dry pigment, and dispersion agent to an extrusion process, wherein the extruder comprises a barrel and at least one screw, said at least one screw comprising a plurality of conveying zones and a plurality of kneading zones.

In a further aspect, the disclosure provides a process for forming a color toner composition, the process comprising providing an extrusion apparatus comprising a feed inlet, a barrel, at least one screw, and a die, said screw comprising a first conveying zone, a first kneading zone, a second conveying zone, a second kneading zone, a third conveying zone, a third kneading zone, and a fourth conveying zone; providing a base toner resin composition; providing a dry pigment; providing a dispersion agent selected from the group of a polyolefinic mono-alcohol, an olefin wax, and combinations thereof; feeding the base toner resin, the dry pigment, and the dispersion agent to the extrusion apparatus via the feed inlet; and combining the base toner resin, dry pigment, and dispersion agent to form a color toner composition; wherein the combining of the base toner resin, dry pigment, and dispersion agent occurs in a single processing step.

In still another aspect, the present disclosure provides a toner composition prepared by at least one of the foregoing processes.

These and other non-limiting aspects and/or objects of the exemplary embodiments disclosed herein are more particularly described below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
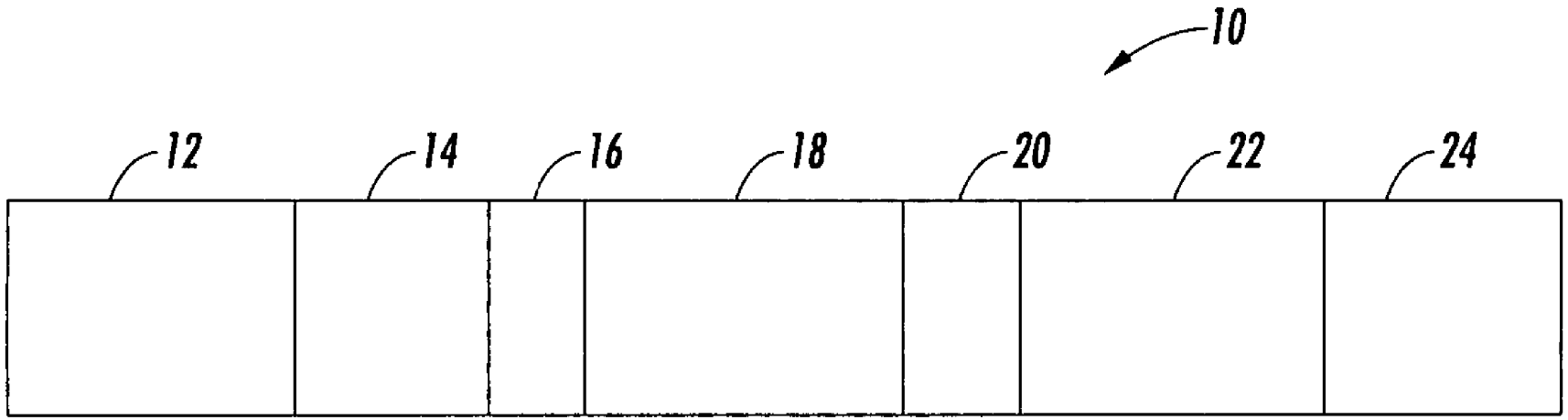
FIG. 1 is a schematic of a screw configuration suitable for use in a process illustrated herein.

The present disclosure is directed, in various exemplary embodiments, to a process for forming toner compositions utilizing dry pigments. Generally, the process comprises combining a dry pigment, a dispersion agent, and a toner composition in a single mixing or processing phase to produce a colored toner. The pigments are in dry form and do not require the additional processing steps involved in forming flush pigments or a pigment pre-dispersion. As used herein, a dry pigment is a pigment substantially free of any liquid, such as water, or a pigment that is not part of pre-dispersion.

In embodiments, the process includes forming a toner composition via an extrusion process. A dry pigment is combined with a dispersing agent and a toner composition in a single step using an extruder. The extruder may have any configuration suitable for use in an extrusion process, and generally comprises a hopper or feed inlet, a screw, and a die or opening through which the final product is extruded. In embodiments, the extruder may be either a single screw or multiple screw, such as, for example, a twin screw extruder. An example of a suitable extruder includes, but is not limited to, a ZSK Super compounder available from Coperion, Ramsey, N.J.

The screw employed in the extrusion process generally comprises a plurality of sections or zones for accomplishing the combining or mixing of the components to yield the final colored toner product. The zones are generally defined by their particular function and/or the design or construction of the screw. Various levels of mixing are achieved by selecting the length and depth of the screw flight (i.e., the helical ridge formed by the machining of the helical channel), the pitch (or helix angle), and the screw diameter (i.e., the outer diameter of the screw). A screw may also comprise for example additional elements attached or mounted thereto, such as, for example, kneading elements, to provide a desired level or type of mixing. The additional elements may further define a section or zone on the screw. Additionally, the level of mixing achieved by the screw is also a function of the length/diameter (L/D) ratio of the screw.

In embodiments, a screw used in the process of forming color toner particles, utilizing a dry pigment, is suitable for promoting distributive mixing by changing material flow direction frequently, increasing the strain distribution function using distributive mixing elements, and breaking up agglomerates. In embodiments, the screw is configured to promote the break up agglomerates, as opposed to rupturing small particles, and to uniformly distribute particles. In one embodiment, the extruder is a twin screw extruder, with each screw comprising a plurality of conveying sections and a plurality of kneading sections. In the conveying sections, the screw comprises a design suitable for conveying a material. The conveying section may be selected from either large pitch or small pitch designs. The configuration of the conveying elements may be selected to maximize intake of feed materials, such as base polymer, dry pigment and dispersion agent. The pitch of the conveyor element may range, in one embodiment, from about 10° to about 60°. Non-limiting examples of suitable conveying elements include 60/60 single flight fast pitch conveying elements and 40/40 medium pitch speed elements. The kneading sections independently comprise a plurality of kneading elements. Any element suitable for performing a kneading function, as is understood in the art, is suitable for use in the kneading sections of a screw or screws employed in a process according to the present disclosure. The kneading elements may include, for example, TME and ZME, turbine and tooth type elements, as well as, left and right hand kneading elements. The screw diameter may be selected based on the size of the extrusion apparatus and may be adjusted as desired by the user. In embodiments, the screw is modular and elements such as, for example, conveying elements, spacers, and/or kneading elements, may be added or removed as needed to achieve the desired level of mixing and to maximize the color gamut of the resulting toner.

With reference to FIG. 1, an example of a screw configuration suitable for use in a process in accordance with the present disclosure is shown. The configuration shown in FIG. 1 is a schematic and the length of the sections is not shown to scale. Screw 10 comprises conveying zone 12, a kneading zone 14, conveying zone 16, kneading zone 18, conveying zone 20, kneading zone 22, and conveying zone 24. Screw 10 may have a length of, for example, about 2200 mm, conveying sections 12, 16, 20, and 24 may have a length of from about 50 mm to about 500 mm, and kneading sections 14, 18, and 22 may have a length of from about 200 to about 600 mm. Both the kneading and conveying sections may optionally include spacers, such as, for example, a ring of about 1 mm.

Figure 2:
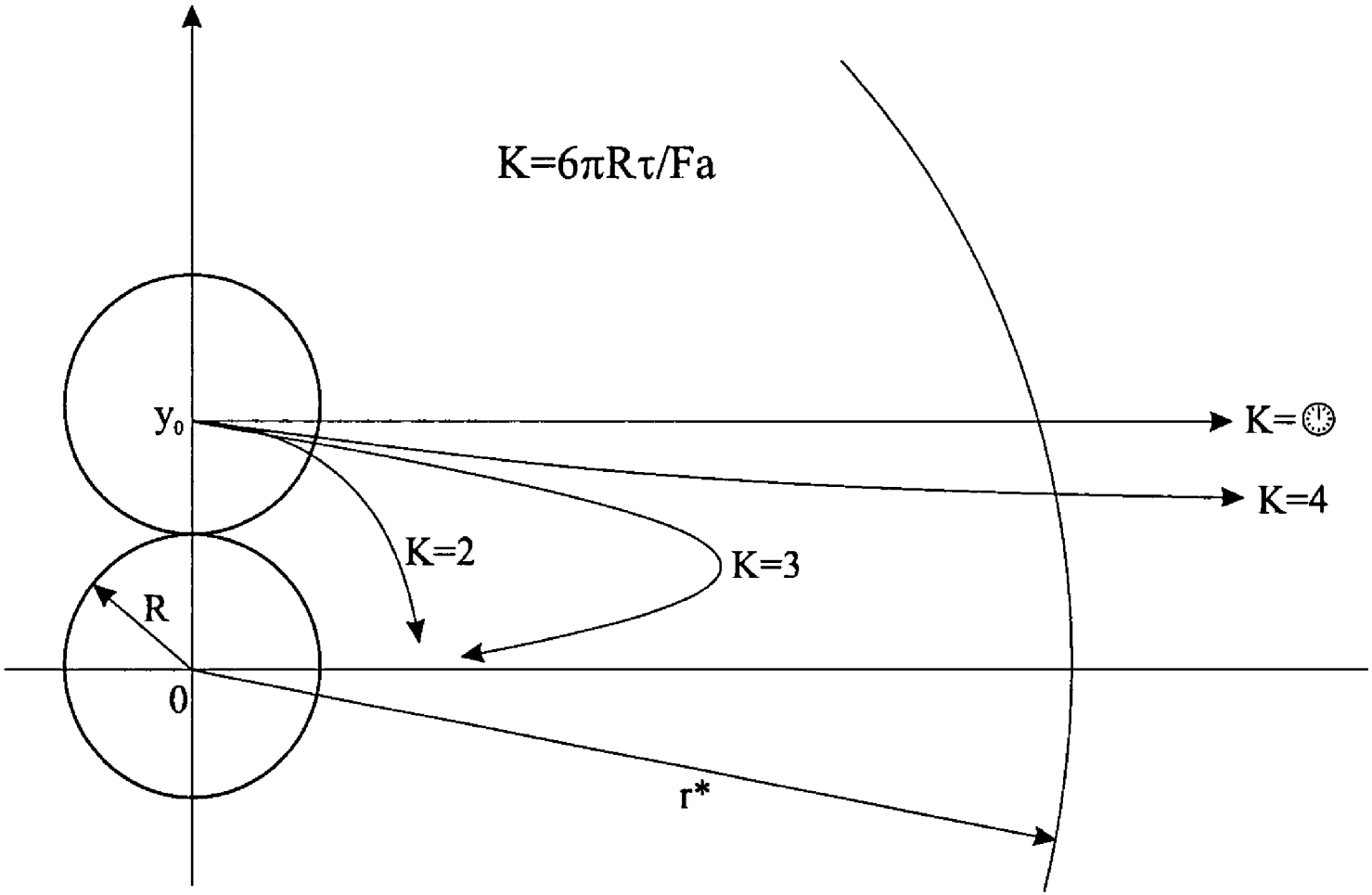
FIG. 2 is a graph depicting process parameters required for dispersing dry pigment particles in the absence of a dispersing agent.
Figure 3:
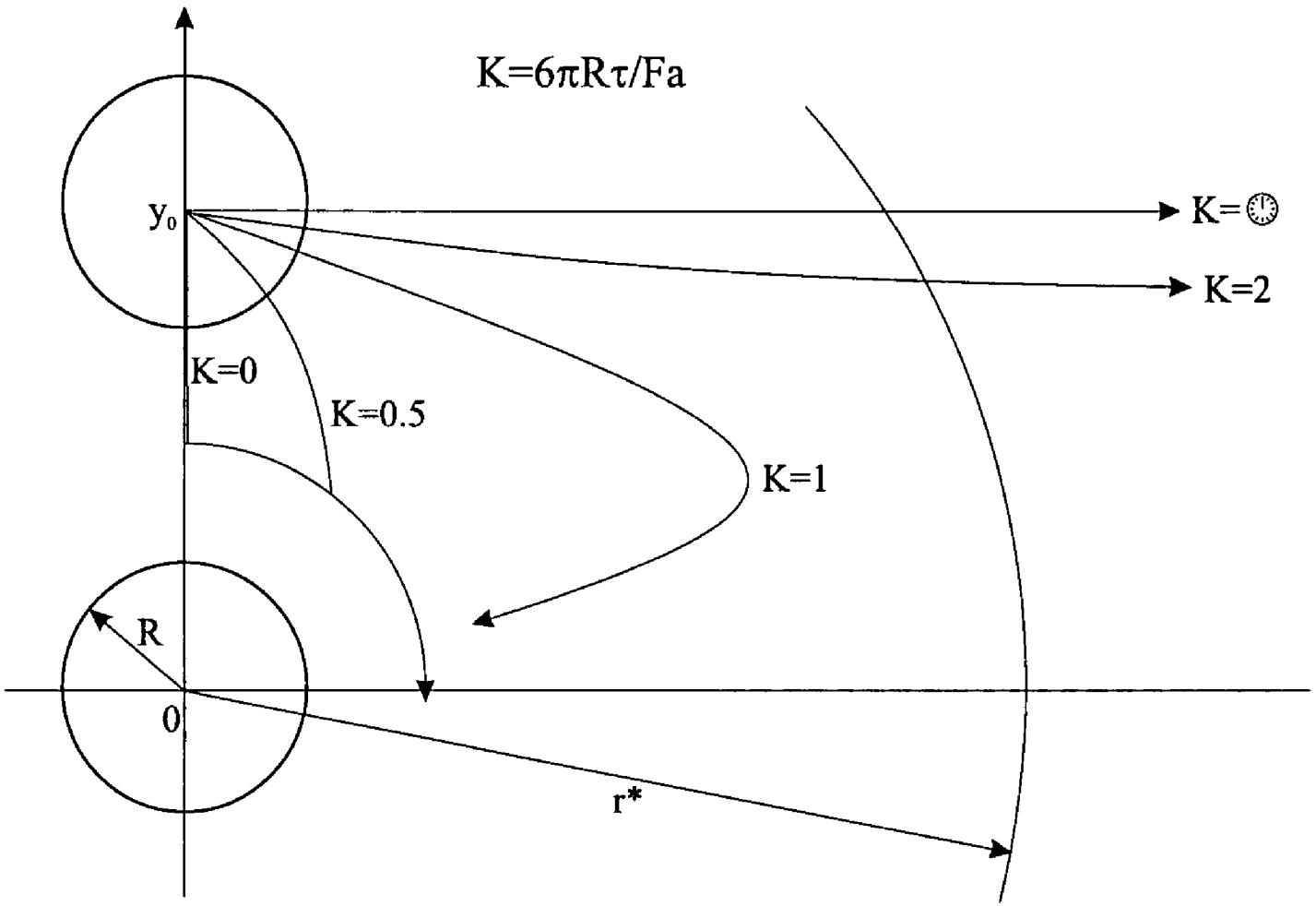
FIG. 3 is a graph depicting the effect of dispersing dry pigment particles in the presence of a dispersing agent or process parameters.

With reference to FIGS. 2 and 3, the mechanism for dispersing the pigment particles during the single step processing of dry pigment and toner resin is described with respect to the ratio (K) of the dispersion force ($6\pi R\tau$) to the aggregation or coalescing force ($F_a$). In FIGS. 2 and 3, the circles along the vertical axis represent pigment particles, R represents the radius of the particles, and r* represents the distance required to maintain separation of particles. When the ratio (K) of the dispersion force to the aggregation force is 1 or lower, the particles are not separated and pigment agglomeration is observed. That is, there is no particle breakup and the particles aggregate due to particle attraction forces such as, for example, van der Waals forces. If the aggregation force is greater than the dispersion force this indicates a strong agglomeration and decreases the dispersion state.

As shown in FIG. 2, in forming a color toner composition by mixing a dry pigment with a toner resin in the absence of a dispersion agent, a large dispersion force is required to disperse the pigment particles and avoid agglomeration. Specifically, a dispersion force at least four times the aggregation force (i.e., K=4) is required to separate the particles. FIG. 2 shows that at a dispersion force three times greater than the aggregation force (i.e., K=3) the pigment particles may initially separate, but soon re-aggregate. Even if it is possible to generate a dispersion force four times greater than the aggregation force, generating such forces is likely to cause a great deal of wear and strain on processing equipment and consume a great deal of energy, which may increase the cost of processing particles in this manner.

In the presence of a dispersion agent, however, as shown in FIG. 3, the dispersion force need only be about twice the aggregation force (i.e., K=2) to maintain particle separation. Without being bound to any particular theory, the initial state of the pigment particles in the presence of the dispersing agent is favorable to particle separation.

As described herein, colored toners particles are formed by providing a resin or polymer composition as the base toner resin and combining the resin or polymer composition with a dry pigment and a dispersion agent. The base toner resin, dry pigment and dispersion agent are then mixed via a processing or mixing apparatus such as, for example, an extruder. Thus, in embodiments, the process according to the disclosure includes mixing and compounding to form and to provide a base toner in a single step, i.e., without forming a pigment pre-dispersion, in an apparatus suitable for combining and blending the components, such as, for example, an extruder, and subjecting the components to a mixing process to yield colored toner product.

In another embodiment, toners may be prepared by co-feeding each of the base toner resin, dry pigment, and dispersion agent separately into the extruder. The process may then be controlled through a closed loop feed back control between an on-line rheometer and feeder (to obtain consistent toner rheological properties). The extruded materials may then subsequently be micronized and classified. The classified materials may be blended with external additives and screened to eliminate large particles after the blending process.

In embodiments, during extrusion, the extruder is heated at different temperatures along the length of the barrel. For example, at the feed section the extruder may be heated at a relatively low temperature of about below the glass transition temperature of the (base) toner resin in order to avoid premature fusing of the powder that comprises the resin. Further away from the feed section, the extruder may be heated to a higher temperature, such as, for example, about above the glass transition temperature, to increase the flow of the mixture and aid in mixing. The heating temperatures may be selected as desired based on the base resin composition.

Processing the toners may further comprise additional processing procedures, including, for example, i) micronization step(s) to reduce the size of large particles to appropriate toner-sized particles, ii) classification to eliminate very small particles, iii) additional blending procedures to blend in external additives to promote flow for improving or optimizing triboelectric characteristics, and/or iv) screening procedures to break up agglomerates of external additives.

The base toner composition, to which color is added via the dry pigment and dispersion agent, is not critical and is not limited in any manner. That is, any polymer or resin composition suitable for use as a toner in a xerographic printing process may be used in a process according to the present disclosure. Examples of materials suitable to form the toners include, but are not limited to, polyesters, polyamides, polyimides, polyethelynes, polypropylenes, polyisobutyrates, acrylic based polymers, such as styrene acrylate, and styrene methacrylate, styrene butadiene, polyesterimide, ethylene-vinyl acetate copolymer, and the like.

Suitable polyester resins include, but are not limited to, polyester SPE2, available from Hercules Chemical, and polyesters of the formula:

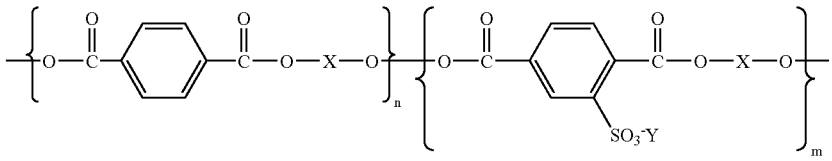

wherein Y is an alkali metal, X is a glycol, and n and m each represent the number of segments.

In embodiments suitable polyester resins include, but are not limited to, salts of copoly(1,2-propylene-dipropylene-5-sulfoisophthalate)-copoly(1,2-propylene-dipropylene terephthalate), copoly(1,2-propylene-diethylene-5-sulfoisophthalate)-copoly(1,2-propylene-diethylene terephthalate), copoly(propylene-5-sulfoisophthalate)-copoly(1,2-propylene terephthalate), copoly(1,3-butylene-5-sulfoisophthalate)-copoly(1,3-butylene terephthalate), copoly(butylenesulfoisophthalate)-copoly(1,3-butylene terephthalate), and the like. Illustrative examples of suitable polyester resins include the beryllium salt of copoly(1,2-propylene-dipropylene-5-sulfoisophthalate)-copoly(1,2-propylene-dipropylene terephthalate), the barium salt of copoly(1,2-propylene-diethylene-5-sulfoisophthalate)-copoly(1,2-propylene-diethylene terephthalate), the magnesium salt of copoly(1,2 dipropylene-5-sulfoisophthalate)-copoly(1,2-propylene terephthalate), the magnesium salt of copoly(1,3-butylene-5-sulfoisophthalate)-copoly(1,3-butylene terephthalate), the calcium salt of copoly(1,2 dipropylene-5-sulfoisophthalate)-copoly(1,2-propylene terephthalate), the calcium salt of copoly(1,3-butylene-5-sulfoisophthalate)-copoly(1,3-butylene terephthalate), the cobalt salt of copoly(1,2-propylene-diethylene-5-sulfoisophthalate)-copoly (1,2-propylene-diethylene terephthalate), the nickel salt of copoly(1,2 dipropylene-5-sulfoisophthalate)-copoly(1,2-propylene terephthalate), the iron salt of copoly(1,3-butylene-5-sulfoisophthalate)copoly(1,3-butylene terephthalate), the zirconium salt of copoly(1,2-dipropylene-5-sulfoisophthalate)-copoly(1,2-propylene terephthalate), the chromium salt of copoly(1,3-butylene-5-sulfoisophthalate)-copoly(1,3-butylene terephthalate), and the like.

Additionally, the polyester resin may be the resins described in U.S. Pat. Nos. 6,593,049, and 6,756,176, the entire disclosures of which are incorporated herein by reference. The toners may also comprise a mixture of an amorphous polyester resin and a crystalline polyester resin as described in copending U.S. Ser. No. 10/349,548, which is published as U.S. Patent Application No. U.S. 2004/0142266, the entire disclosure of which is incorporated herein by reference.

Examples of latex resins or polymers suitable for use in toner particles include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate-butadiene), poly(butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid). In embodiments, the resin or polymer is a styrene/butyl/acrylic acid terpolymer.

The base toner (resin) composition may be prepared by any suitable process of method. The process to form a resin composition may be selected as desired to produce the desired resin composition.

As described herein, color toner particles are formed by combining a base resin composition with a dry pigment and a dispersion agent, optionally followed by subsequent size reduction, classification and/or optional additive blending processes. Any dry pigment suitable for imparting a color to a toner is suitable for use in the present process. Colored toner particles may be prepared by using colored pigments, such-as, for example, cyan, magenta, yellow, red, green, brown, blue, or mixtures thereof.

Examples of suitable pigments include, but are not limited to the dry form of phthalocyanine HELIOGEN BLUE L6900™, L7020™, D6840™, D7080™, D7020™, K6910™, and K7020™, available from BASF, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows are diarylide yellow 3,3-dichlorobenzidene acetoacetanilides, a monoazo pigment identified in the Color Index as CI 12700. Other known colorants can be selected, such as Levanyl Black A-SF (Miles, Bayer) and Sunsperse Carbon Black LHD 9303 (Sun Chemicals), Paliogen Black L9984 9BASF), Pigment Black K801 (BASF) and particularly carbon blacks such as REGAL 330, REGAL 660 (Cabot), Carbon Black 5250 and 5750 (Columbian Chemicals), and colored dyes such as Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Scarlet for Thermoplast NSD Red (Aldrich), Neopen Blue FF4012 (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan II (Matheson, Coleman, Bell), Sudan III (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991 K (BASF), Paliotol Yellow 1840 (BASF), Neopen Yellow (BASF), Novoperm Yellow FG 1, and FGL (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Sico Fast Yellow D1165, D1355, and D1351 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF). Additional useful colorants include dry pigments commercially available from Sun Chemical, such as, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LFD 4343 and LFD 9736 (Pigment Black 7 77226) and the like or mixtures thereof. Other suitable pigments include dry pigments such as Toner Magenta EO2 available from Clariant.

The dispersion agent is employed to adequately disperse the pigment in the base toner composition to yield the final toner product. Sufficient dispersion of the pigment in the base toner composition is important for maximizing the color gamut. Some of the dispersion agent is also incorporated into the final toner product. The incorporation of the dispersion agent into the final toner product may serve as a lubricant in the toner product and reduce friction and temperature rise of the toner materials during printing. The effect of this may be to increase the effective life of the fuser roll.

Any material suitable for dispersing dry pigment in a base toner composition is suitable for use in the present process as the dispersion agent. Suitable dispersion agents include, but are not limited to, polyolefinic mono-alcohols and olefin waxes. Examples of suitable polyolefinic mono-alcohols include UNILIN waxes, including, for example, UNILIN 425, UNILIN 550 and UNILIN 700. Suitable olefin waxes include, but are not limited to polyethylene wax, polypropylene wax, oxidized polyethylene wax, oxidized polypropylene wax, or the like.

The base toner resin composition may be present in an amount of from about 80 to about 98 percent by weight, the pigment is present in an amount of from about 1 to about 10 percent by weight, and the dispersion agent is present in an amount of from about 1 to about 10 percent by weight of the total weight of the toner components. The total amount of the components added should total 100%. The amount of each component refers to the amount of that component added during the process. In embodiments, the base toner resin composition is present in an amount of from about 90 to about 98 percent by weight, the pigment is present in an amount of from about 1 to about 5 percent by weight and the dispersion agent is present in an amount of from about 1 to 5 percent by weight. In other embodiments, the base toner resin composition is present in an amount of from about 80 to about 90 percent by weight, the pigment is present in an amount of from about 1 to about 10 percent by weight, and the dispersion agent is present in an amount of from about 1 to about 10 percent by weight.

A process for forming a toner composition with a dry pigment is further described with reference to the following examples. The examples are not intended to be limiting in any manner, but are merely illustrative embodiments of a process in accordance with the present disclosure.

EXAMPLES

Preparation of Color Toner Particles

Base toner particles were prepared as follows. A heterogeneous base polymer (polyester) having a distinctively different morphology (gel) with bi-modal Mw distribution was created through reactive extrusion process. The above base polymer generally has about 20-40% gel content (high Mw portion). The base polymer is fed into a co-rotating twin screw extruder (described below) together with the desired color pigment to produce base toner particles. The (third) set of toners prepared by the process according to the present disclosure by feeding the dispersing agent into the extruder together with the base polymer and the desired dry pigment. The toners were processed at 250 rpm and 250 lb/hr at a barrel temperature 200° C. for the first 5 barrels and 70° C. for the last 6 barrels. A Type "C" screw configuration as described below (and shown in FIG. 5) was used to disperse the dry pigment. The base toners were then micronized and classified to eliminate large particles and fine particles.

Figure 5:
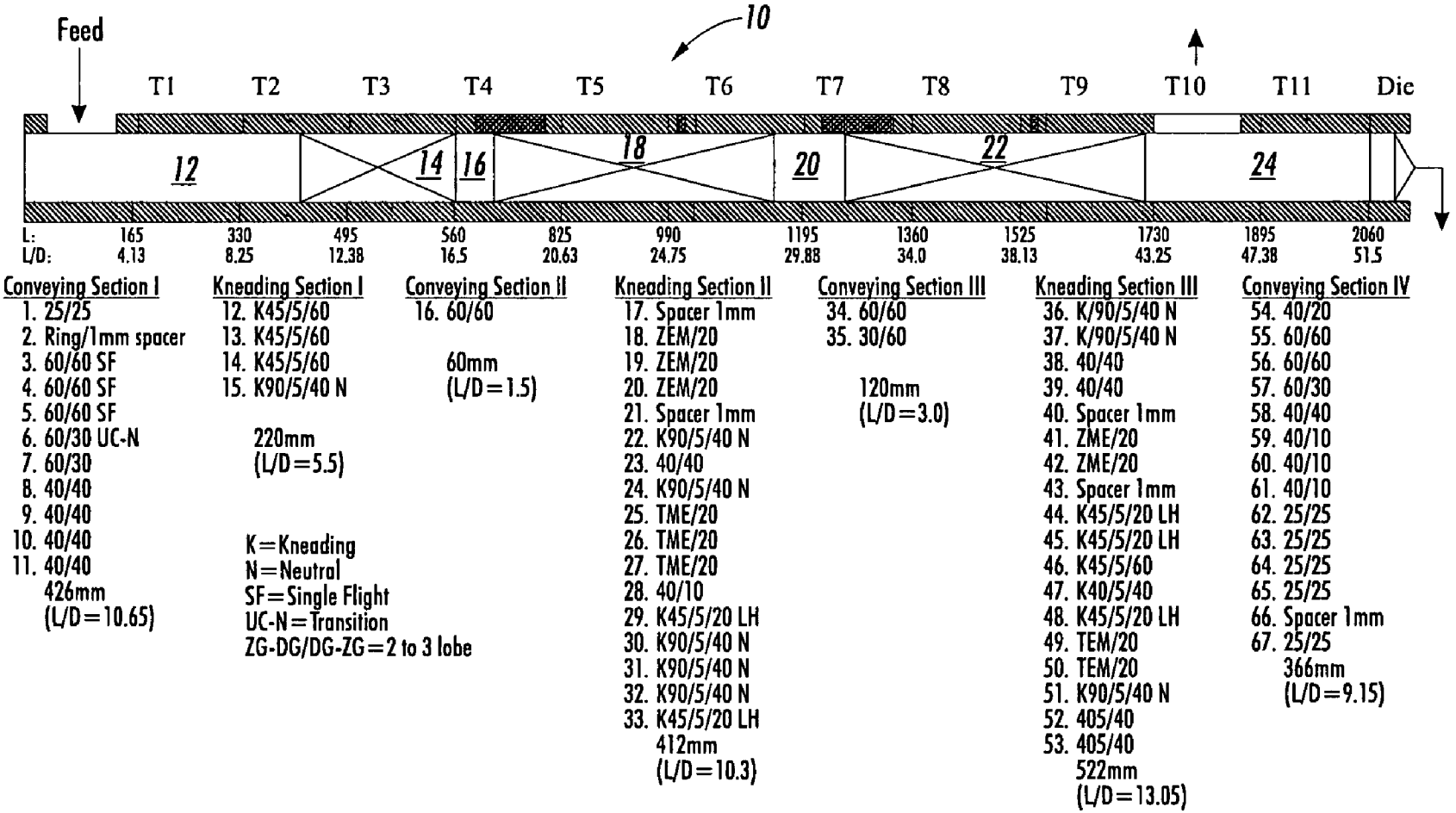
FIG. 5 is a schematic representation of a screw configuration for an extrusion process designated herein as a Type C screw.

Each set of toner particles was prepared by combining the pigment with one of the base toner particles via an extrusion process. The extruder was a ZSK-40 Supercompounder twin-screw extruder available from Coperion. The screws employed in the process had a configuration designated as Screw Configuration "C". The Type "C" configuration screw was designed such a way that dispersive mixing and distributive mixing occur alternatively. The first kneading section (14) is to generate dissipative mixing, in which generate extremely high stress to rupture any large particles and agglomerates. The material thereafter goes through distributive mixing sections (TME and ZME kneading sections) and dispersive mixing sections (indicated K in front of element in FIG. 5) alternatively for effective dispersion of dry pigment throughout matrix polymer. It is described with reference to FIGS. 1 and 5. FIG. 5 is a detailed schematic of the Type C screw configuration. The twin-screw had a total length of 2,126 mm and an L/D of about 53.15. A first conveying section or zone (12) had a length of 426 mm and an L/D of about 10.65. The screw in the first conveying section comprised a 25/25 conveying element at the feed inlet, a 1 mm spacer ring, then a 60/60 single flight fast pitch conveying element, a section of 60/30 conveying elements, and was then reduced to a section of 40/40 medium pitch speed elements. A first kneading section (14), beginning at about 426 mm, had a length of 220 mm and comprised 45/5/60 and 90/5/40 kneading elements available from Coperion in Ramsey, N.J. The first kneading section had an L/D of about 5.5. The second conveying section (16), beginning at about 646 mm, had a length of 60 mm, an L/D of about 1.5, and comprised a 60/60 conveying element. The second kneading section (18), which began at about 706 mm, had a length of 412 mm and an L/D of about 10.3. The second kneading section comprised ZME tooth type elements (20 mm) 90/5/40 kneader elements, 40/40 and 40/10 conveying elements, TME turbine type elements (20 mm), and 45/5/20 left-hand kneading elements. The third conveying section (20), beginning at about 1178 mm, had a length of 120 mm, an L/D of about 3.0, and comprised 60/60 and 30/60 conveying elements. The third kneading section (22), beginning at about 1,178 mm, had a length of 522 mm and an L/D of about 13.05. The third kneading section comprised 90/5/40 kneading elements, 40/40 conveying elements, ZME tooth type elements (20 mm), 45/5/20 left-hand kneading elements, a 45/5/60 kneading element, a 45/5/40 kneading element, TME turbine type kneading elements (20 mm), and 40/5/40 elements. The fourth conveying section (24), beginning at about 1700 mm, had a length of 366 mm, an L/D of about 9.15, and comprised a 40/20 conveying element, 60/60 conveying elements, a 60/30 conveying element, a 40/40 conveying element, 40/10 conveying elements, and 75/75 conveying elements. The extruder also included a slit die.

Three sets of yellow, cyan, and magenta toners were prepared. The sets of toners included: 1) a set of toners made with flushed pigments; 2) a set of toners made with dry pigments, but processed without the benefit of a dispersion agent; and 3) a set of toners prepared in accordance with the present disclosure employing dry pigments and a dispersion agent. In the examples, the dispersion agent used was UNILIN wax. The flushed pigments used to form the toners included Pigment Yellow 17 Flushed, Pigment Blue 15:3 (PV Fast Blue) Flushed, and Pigment Red 81:2 Flushed, available from Sun Chemicals. The dry pigments used were the "unflushed," dry versions of the above pigments. Each of the toners was prepared by combining the respective components in the extruder.

Tables 1 and 2 show the compositions for the control toners, i.e., toners prepared with either a) flushed pigments or b) with a dry pigment but without the aid of a dispersing agent. After extrusion, the toner particles were micronized and classified to eliminate large particles and fine particles. All percentages given are in percent by weight of the total components added.

TABLE 1

Toners Prepared with Flush Pigments

| TONER COLOR | AMOUNT OF POLYMER ADDED | PIGMENT | AMOUNT OF PIGMENT ADDED |
|---|---|---|---|
| Yellow | 95% | Pigment Yellow 17 Flushed | 5% |
| Cyan | 96.7% | Pigment Blue 15:3 Flushed | 3.3% |
| Magenta | 97% | Pigment Red 81:2 Flushed | 3% |

TABLE 2

Toners Prepared with Dry Pigment (No Dispersion Agent)

| TONER COLOR | AMOUNT OF POLYMER ADDED | PIGMENT | AMOUNT OF PIGMENT ADDED |
|---|---|---|---|
| Yellow | 95% | Pigment Yellow 17 Dry | 5% |
| Cyan | 96.7% | Pigment Blue 15:3 Dry | 3.3% |
| Magenta | 97% | Pigment Red 81:2 Dry | 3% |

Table 3 shows toners prepared by a process in accordance with the present disclosure, i.e., by a one-step process employing a dry toner and a dispersion agent. The toners were prepared as described herein with the base polymer described above, the indicated dry pigment, and a dispersant (UADD). The extruded toners were further micronized and classified to eliminate large particles and fine particles.

TABLE 3

Toners Prepare with Dry Toner and Dispersion Agent

| TONER COLOR | AMOUNT OF BASE TONER ADDED | PIGMENT | AMOUNT OF PIGMENT ADDED | DISPERSION AGENT | AMOUNT OF DISPERSION AGENT ADDED |
|---|---|---|---|---|---|
| Yellow | 90% | Pigment Yellow 17 Dry | 5% | Unilin (1/1/) | 5% |
| Cyan | 95.05% | Pigment Blue 15:3 Dry | 3.3% | Unilin (2/1) | 1.65% |
| Magenta | 94% | Pigment Red 81:2 Dry | 3% | Unilin (1/1) | 3% |

Figure 4:
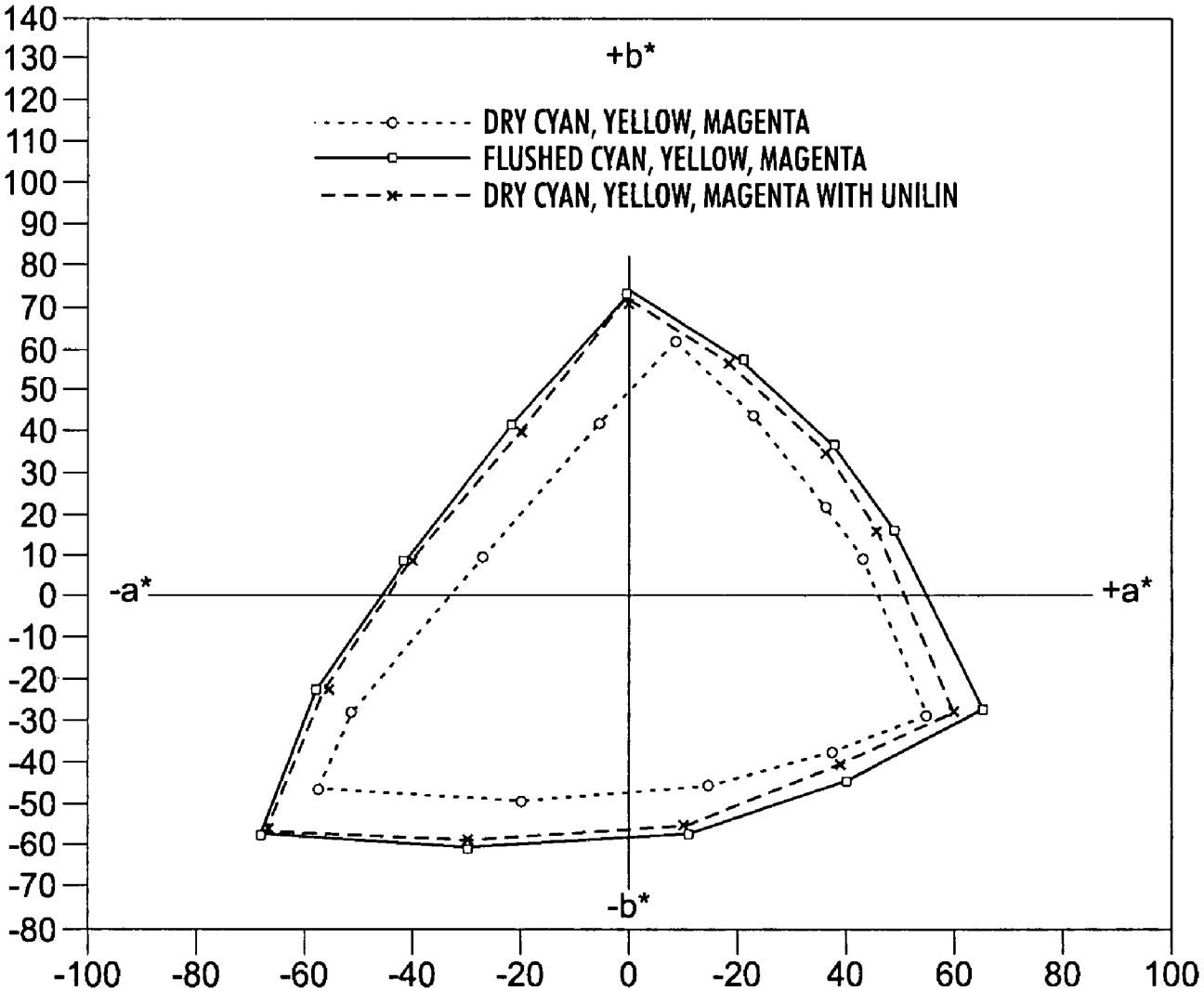
FIG. 4 is a graph comparing the color gamut of toners prepared with dry pigments and flushed pigments to toners prepared from the process disclosed herein.

Color gamut was evaluated for each of the above color toners as defined by CIE lab specifications as is known in the art. FIG. 4 is a graph showing the color gamut for each of the toners. As can be seen in FIG. 4, toners prepared by a process in accordance with the present disclosure, i.e., toners prepared with a dry pigment and a dispersion agent, had a color gamut comparable to toners prepared with the flush pigments. The toners prepared by a process according to the present disclosure had a larger color gamut as compared to toners prepared using dry pigments without the aid of a dispersion agent.

Figure 6:
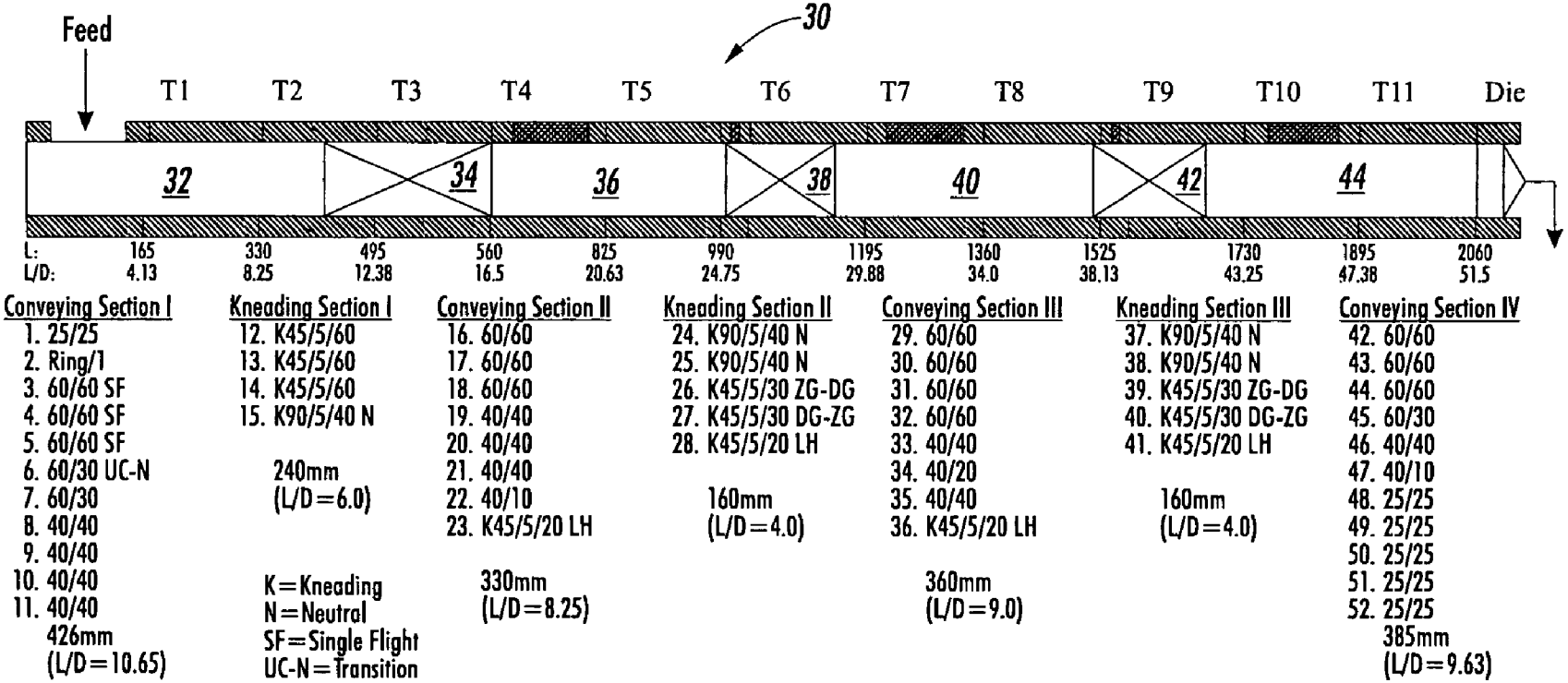
FIG. 6 is a schematic representation of a screw configuration for an extrusion process designated herein as a Type A screw.

Table 4 compares the projection efficiency (PE), i.e., the ability to project a clear, clean color image on a screen through a transparency, of toners prepared via the different processes. The projection efficiency was evaluated using both the screw configuration designated Type C, previously described herein, and a different screw configuration designated "Screw Configuration A" (Type A). A schematic of the Type A screw configuration is depicted in FIG. 6. The Type A screw had a length of 2061 nm and an L/D of 51.5. With reference to FIG. 6, the Type A screw 30 included a first conveying zone 32, a first kneading zone 34, a second conveying zone 36, a second kneading zone 38, a third conveying zone 40, a third kneading zone 42, and a fourth conveying section 44. The details regarding the length, L/D ratio, and elements used in the respective zones/sections is also shown in FIG. 6.

TABLE 4

| PIGMENT | PE FROM SCREW CONFIGURATION A | PE FROM SCREW CONFIGURATION C |
|---|---|---|
| Pigment Yellow 17 Flushed | — | 89 |
| Pigment Yellow 17 Dry | — | 56 |
| Pigment Yellow 17 and Unilin 1/1 | — | 85 |
| Pigment Blue 15:3 Flushed | — | 95 |
| Pigment Blue 15:3 Dry | — | 81 |
| Pigment Blue 15:3 Dry and Unilin 2/1 | — | 93 |
| Pigment Red 81:2 Flushed | — | 83 |
| Pigment Red 81:2 Dry | 59 | — |
| Pigment Red 81:2 Dry and Unilin 1/1 | 59 | |

As shown in Table 4, toners prepared via a process in accordance with the present disclosure had projection efficiencies comparable to projection efficiencies of toners prepared using flush pigments, and better than toners prepared using dry pigments without the aid of a dispersion agent. Table 4 also shows the effect that screw configuration may have on toner processing.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A process form forming a toner composition, the process comprising:

providing an extrusion apparatus, combining a base toner resin composition, a dry pigment, and a dispersion agent selected from the group of a polyolefinic mono-alcohol, an olefin wax, and combinations thereof in the extrusion apparatus; and forming a color toner by subjecting said base toner resin composition, said dry pigment, and said dispersion agent to an extrusion process.

2. The process according to claim 1, wherein said dry pigment is added in an amount of from about 1 to about 10 percent by weight.

3. The process according to claim 1, wherein said dispersion agent is added in an amount of from about 1 to about 10 percent by weight.

4. The process according to claim 1, wherein said base toner resin is added in an amount of from about 80 to about 98 percent by weight.

5. The process according to claim 1, wherein said extrusion apparatus comprises at least one screw, said at least one screw comprising a plurality of conveying sections and a plurality of kneading sections.

6. A process for preparing a toner comprising:

providing a base toner resin composition;

feeding the base toner composition, a dry pigment, and a dispersion agent selected from the group of a polyolefinic mono-alcohol, an olefin wax, and combinations thereof to an extruder; and subjecting the base toner resin, dry pigment, and dispersion agent to an extrusion process, wherein the extruder comprises a barrel and at least one screw, said at least one screw comprising a plurality of conveying zones and a plurality of kneading zones.

7. The process according to claim 6, wherein the dispersion agent is an olefin wax.

8. The process according to claim 6, wherein the screw has a configuration such that the conveying zones and kneading zones alternate along the length of the screw.

9. The process according to claim 6, further comprising heating the extruder along the length of the barrel.

10. The process according to claim 9, wherein the extruder is heated at about a feed section of the extruder at a temperature about below the glass transition temperature of the base toner.

11. The process according to claim 9, wherein the extruder is heated above the glass transition temperature of the base toner at a location down field of a feeder section of the extruder.

12. A process for forming a color toner composition, the process comprising:

providing an extrusion apparatus comprising a feed inlet, a barrel, at least one screw, and a die, said screw comprising a first conveying zone, a first kneading zone, a second conveying zone, a second kneading zone, a third conveying zone, a third kneading zone, and a fourth conveying zone;

providing a base toner resin composition;

providing a dry pigment;

providing a dispersion agent selected from the group of a polyolefinic mono-alcohol, an olefin wax, and combinations thereof;

feeding the base toner resin, the dry pigment, and the dispersion agent to the extrusion apparatus via the feed inlet; and combining the base toner resin, dry pigment, and dispersion agent to form a color toner composition;

wherein the combining of the base toner resin, dry pigment, and dispersion agent occurs in a single processing step.

13. The process according to claim 12, wherein said first conveying zone has a length/diameter ratio of about 10.65, said first kneading zone has a length/diameter ratio of about 5.5, said second conveying zone has a length/diameter ratio of about 1.5, said second kneading zone has a length/diameter ratio of about 10.3, said third conveying zone had a length/diameter ratio of about 3.0, said third kneading zone had a length/diameter ratio of about 13.05, and said fourth conveying zone had a length/diameter ratio of about 9.15.

14. The process according to claim 12, wherein said dry pigment is provided in an amount of about 1 to about 10, and said dispersion agent is provided in an amount of about 1 to about 10.

15. The process according to claim 12, wherein said dispersion agent is selected from the group consisting of polyolefinic mono-alcohols.

* * * * *